US005720247A

United States Patent [19]

Suzuki et al.

[11] Patent Number: 5,720,247

[45] Date of Patent: Feb. 24, 1998

[54] ENGINE STARTER

[75] Inventors: Satoru Suzuki; Noriaki Moriyama; Akira Morishita, all of Tokyo, Japan

[73] Assignee: Mitsubishi Denki Kabushiki Kaisha, Tokyo, Japan

[21] Appl. No.: 794,024

[22] Filed: Feb. 3, 1997

[30] Foreign Application Priority Data

Jul. 1, 1996 [JP] Japan ..... 8-171335

[51] Int. Cl.[6] ..... F02N 11/00

[52] U.S. Cl. ..... 123/179.25; 123/195 A; 290/48

[58] Field of Search ..... 123/179.25, 179.26, 123/195 A, 195 E; 290/38 R, 48

[56] References Cited

U.S. PATENT DOCUMENTS

| | | | |
|---|---|---|---|
| Re. 35,425 | 1/1997 | Isom et al. | 123/195 A |
| 4,918,324 | 4/1990 | Isozumi | 290/48 |

FOREIGN PATENT DOCUMENTS

| | | |
|---|---|---|
| 61-184260 | 11/1961 | Japan . |
| 56-23493 | 6/1981 | Japan . |
| 57-132628 | 8/1982 | Japan . |
| 63-131860 | 6/1988 | Japan . |

*Primary Examiner*—Andrew M. Dolinar

*Attorney, Agent, or Firm*—Sughrue, Mion, Zinn, Macpeak & Seas, PLLC

[57] ABSTRACT

In an engine starter, a plurality of mounting seats 12 for mounting an auxiliary switch 8 are provided on a housing 11. Accordingly, the auxiliary switch 8 can be mounted to the same housing 11 without interfering with neighboring equipment or the like with different engine or car body combinations. Standardization of the housing 11 can therefore easily achieved.

3 Claims, 6 Drawing Sheets

ENGINE STARTER

BACKGROUND OF THE INVENTION

1. Field of the Invention

This invention relates to an engine starter having an auxiliary switch which turns an electric current for exciting an electromagnetic switch on and off.

2. Description of the Related Art

FIG. 8 is a front view showing an example of a conventional engine starter and FIG. 9 is a left side view of FIG. 8. In the figures, a motor 1 is supported by a housing (front housing) 2. A transmission mechanism (not shown) for transmitting the drive force of the motor 1 to a pinion 3 is accommodated in the housing 2. The transmission mechanism includes a reduction mechanism and an overrunning clutch. The pinion 3 is capable of contacting with and separating from a ring gear (not shown) of the engine.

A projecting portion (switch box portion) 2*a* provided at the outer periphery of the housing 2. An electromagnetic switch (main switch) 4 which turns an electric current for the motor 1 on and off is mounted to the projecting portion 2*a* through screws 5. Further, the overrunning clutch is operated by the electromagnetic switch 4 through a lever (not shown), thereby moving the pinion 3 back and forth into and out of contact with the ring gear.

An auxiliary switch 8 is mounted to the left side portion of the projecting portion 2*a* in FIG. 8 through a supporting member 6 and screws 7. The auxiliary switch 8 is electrically connected to the electromagnetic switch 4 through wires 9. Auxiliary switch 8 also turns an electric current on and off for exciting the electromagnetic switch 4 by being excited by a key switch (not shown).

In this conventional engine starter, the auxiliary switch 8 is excited by turning on the key switch, to thereby excite the electromagnetic switch 4. When the electromagnetic switch 4 is excited, an electric current flows into the motor 1 and the pinion 3 is brought into contact with the ring gear, to thereby rotate the ring gear by the transmitted drive force. In engine starters employed for large-sized engines, since an electric current of hundreds of amperes flows into the motor 1, the electromagnetic switch 4 is not excited directly by the key switch but through the auxiliary switch 8.

Next, FIG. 10 is a front view showing another example of a conventional engine starter and FIG. 11 is a right side view of FIG. 10. In this example, the auxiliary switch 8 is mounted to the top portion of the projecting portion in FIG. 10. Further, a flange member 10 for mounting the housing 2 to the engine is attached to the housing 2 and the mounting angle of the housing 2 to the flange member 10 can be changed.

In this example, since the housing 2 is mounted to the engine through the flange member 10 and the mounting angle of the housing 2 against the flange member 10 can be changed, the mounting angle of the whole of the engine starter against the engine can be suitably selected.

Conventional engine starters having the auxiliary switch described above are disclosed, for example, in Japanese Utility Model Laid-Open No. 61-184260 and Japanese Patent Publication No. 6-33748.

However, even though the mounting angle of the whole of the engine starter against the engine can be changed in conventional engine starters with the above-described construction with the same kind of housing 2, the auxiliary switch 8 must be mounted in the same position because each housing 2 has only one mounting seat for the auxiliary switch 8. In contrast, when the engine or car body is different, the configuration of the engine or layout of equipment set up around the engine are different respectively. Therefore, the auxiliary switch 8 sometimes interferes with the engine block or the neighboring equipment even though the mounting angle of the engine starter is the same. In such cases, it is necessary to produce a new housing by changing the position of the mounting seat for the auxiliary switch 8. Also, it is necessary to produce or modify a mold for the new housing.

SUMMARY OF THE INVENTION

The present invention has been achieved with a view toward solving the problems described above, and it is an object of the present invention to provide an engine starter which is capable of mounting an auxiliary switch to the same housing even with different engine or car body combinations.

To this end, according to one aspect of the present invention, there is provided an engine starter, comprising: a starter body including: a housing provided with a plurality of auxiliary switch mounting seats, a motor supported by the housing, a pinion capable of being contacted with and separated from a ring gear of an engine, the pinion being rotated by the drive force of the motor, and a transmission mechanism for transmitting the drive force of the motor to the pinion, the transmission mechanism being accommodated in the housing; an electromagnetic switch for bringing the pinion into contact with the ring gear, for separating the pinion from the ring gear, and for turning an electric current to the motor on and off, the electromagnetic switch being mounted to the housing; and an auxiliary switch for turning an electric current for exciting the electromagnetic switch on and off, the auxiliary switch being mounted to one of the auxiliary switch mounting seats.

DESCRIPTION OF THE PREFERRED EMBODIMENT

Figure 1:
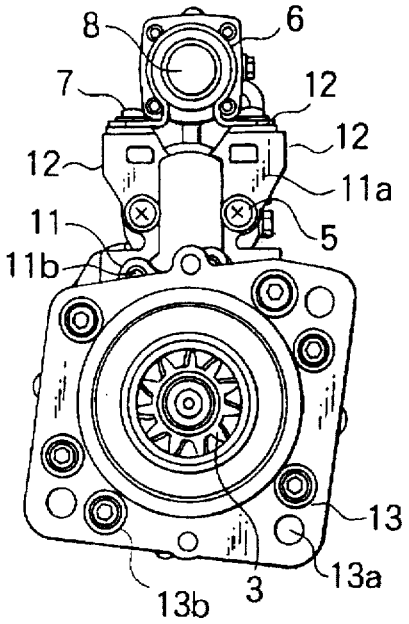
FIG. 1 is a front view showing an engine starter as one embodiment of this invention.
Figure 2:
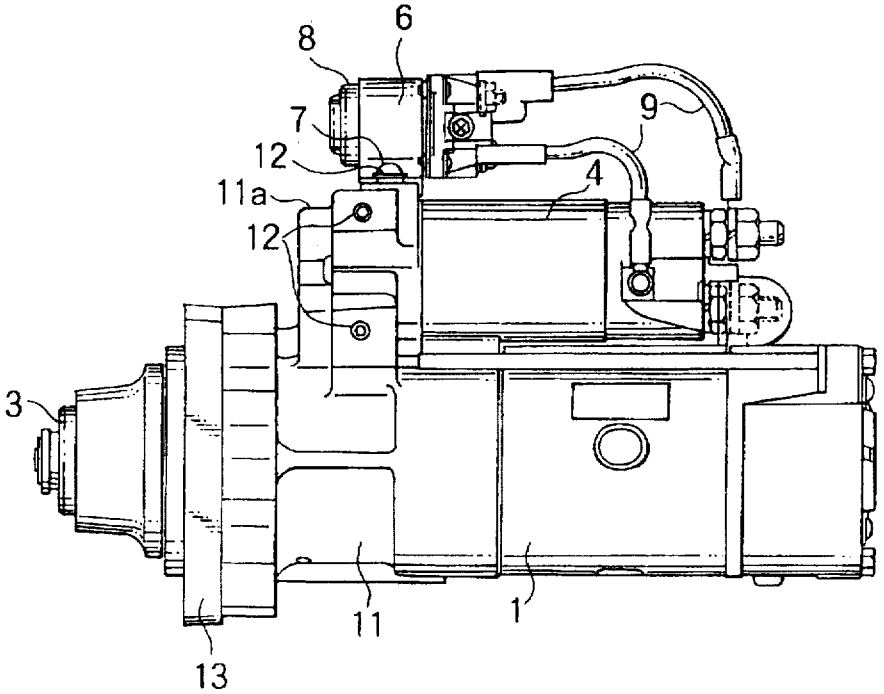
FIG. 2 is a right side view of FIG. 1.
Figure 3:
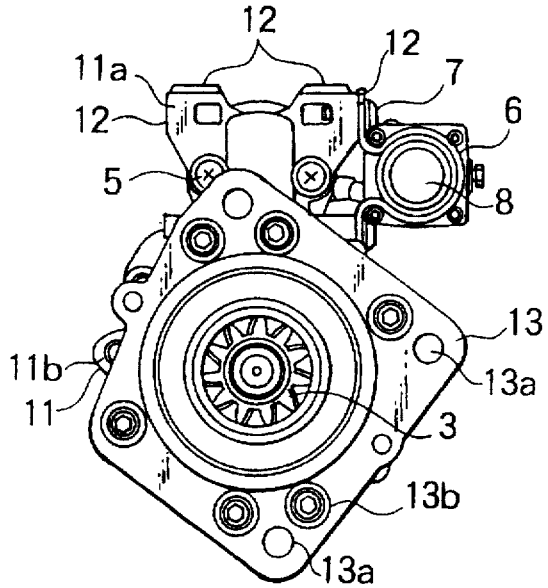
FIG. 3 is a front view showing another mounting state of an auxiliary switch in FIG. 1.
Figure 4:
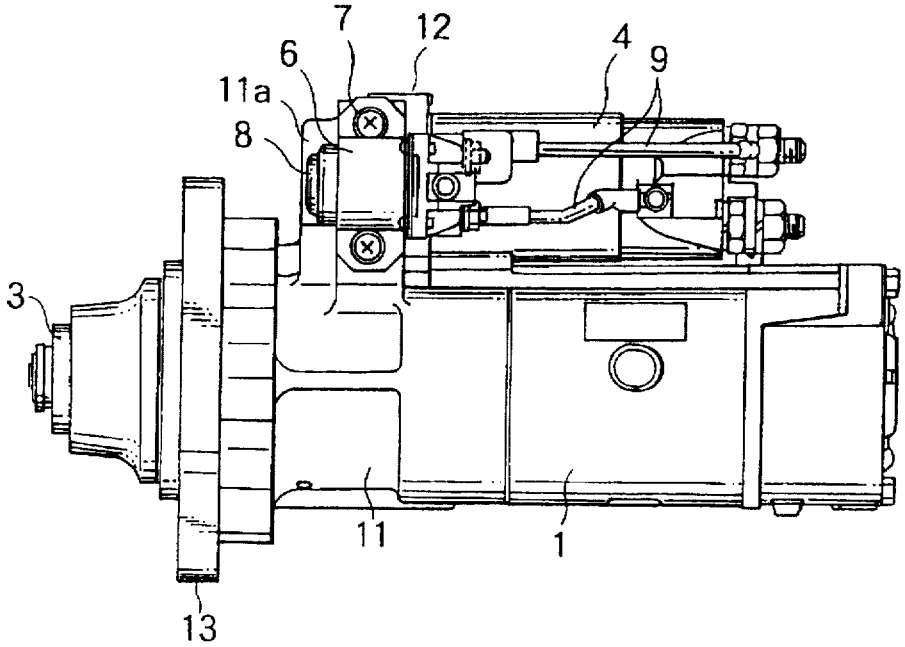
FIG. 4 is a right side view of FIG. 3.
Figure 5:
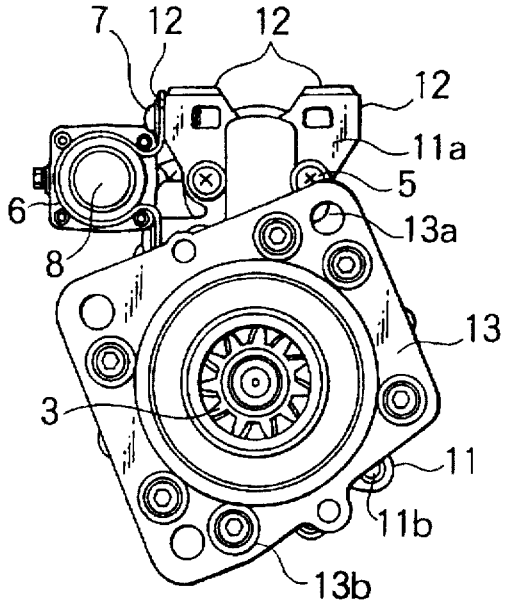
FIG. 5 is a front view showing another mounting state of the auxiliary switch in FIG. 1.

The embodiment according to the present invention will now be described with reference to the accompanying drawings. FIG. 1 is a front view showing an engine starter as one embodiment of the invention. FIG. 2 is a right side view of FIG. 1. FIG. 3 is a front view showing another mounting state of the auxiliary switch in FIG. 1. FIG. 4 is a right side view of FIG. 3. FIG. 5 is a front view showing another mounting state of the auxiliary switch in FIG. 1.

Figure 6:
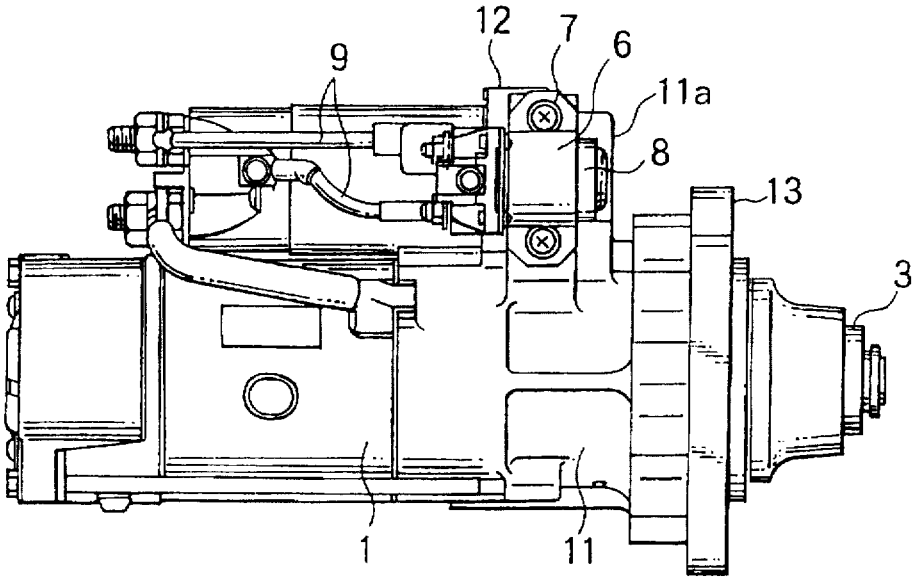
FIG. 6 is a left side view of FIG. 5.
Figure 7:
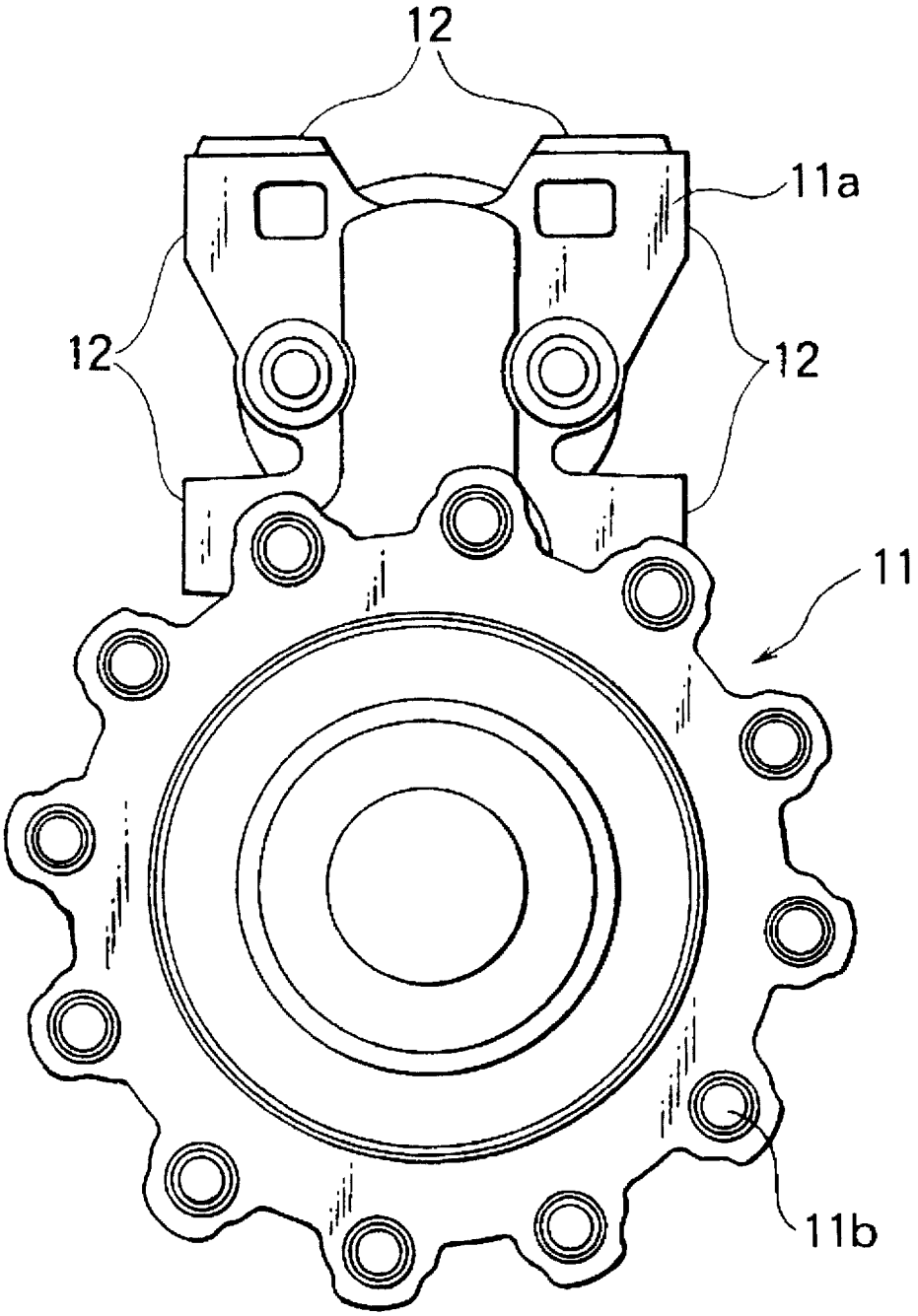
FIG. 7 is a front view showing a housing in FIG. 1.
Figure 8:
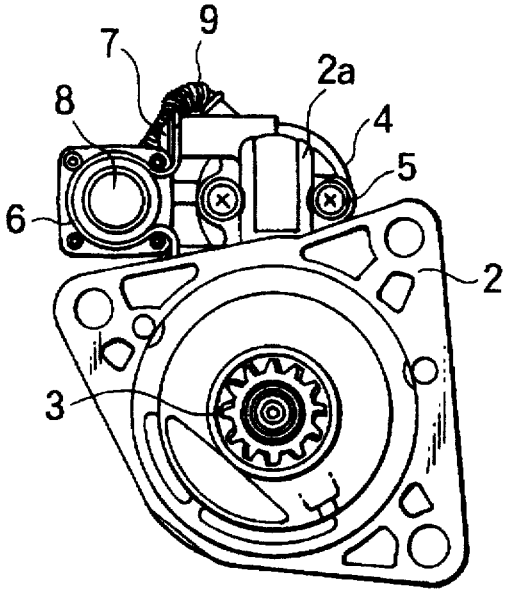
FIG. 8 PRIOR ART
FIG. 8 is a front view showing an example of a conventional engine starter.
Figure 9:
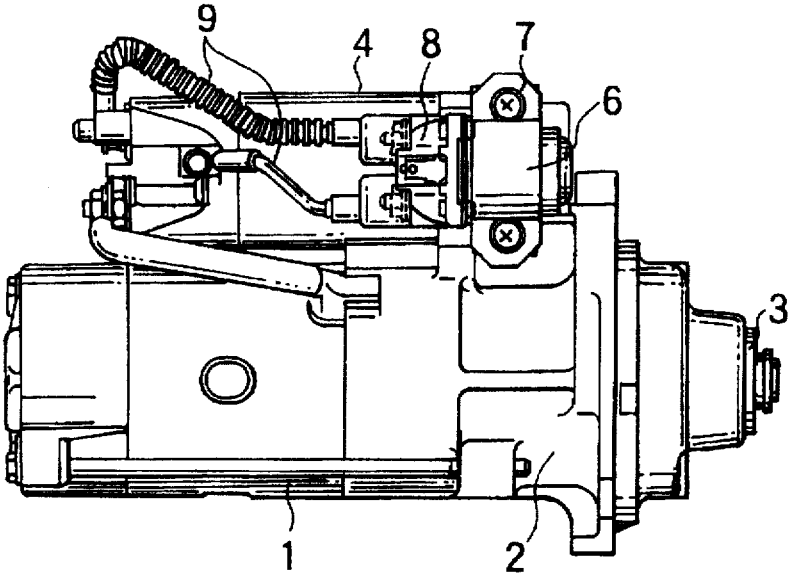
FIG. 9 PRIOR ART
FIG. 9 is a left side view of FIG. 8.
Figure 10:
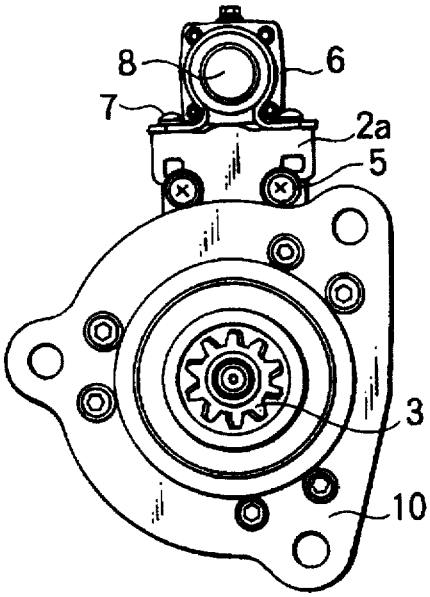
FIG. 10 PRIOR ART
FIG. 10 is a front view showing another example of a conventional engine starter.
Figure 11:
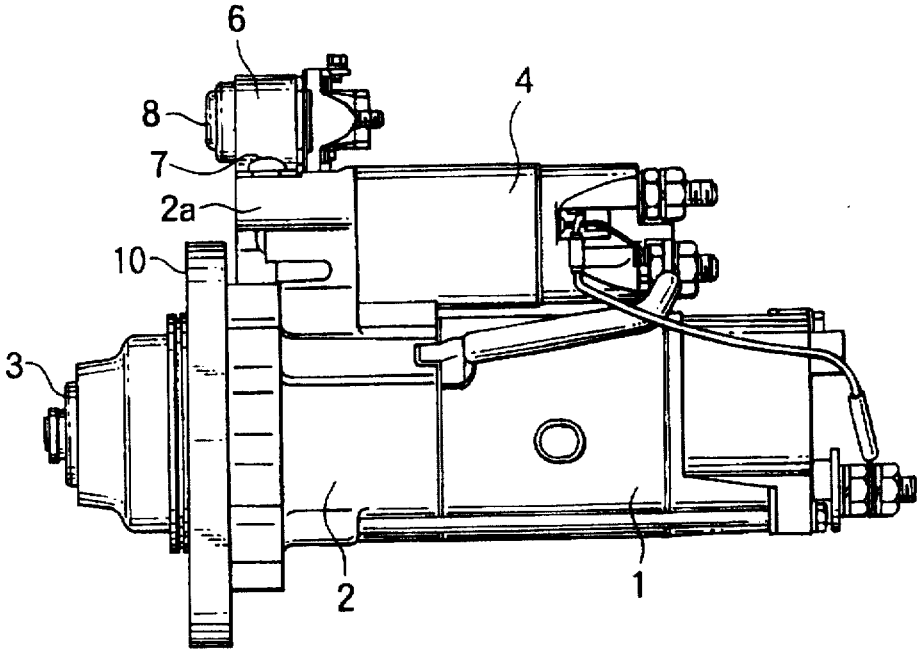
FIG. 11 PRIOR ART
FIG. 11 is a right side view of FIG. 10.

FIG. 6 is a left side view of FIG. 5. FIG. 7 is a front view showing a housing in FIG. 1.

In the figures, a motor 1 is supported by a housing (front housing) 11. A transmission mechanism (not shown) for transmitting the drive force of the motor 1 to a pinion 3 is accommodated in the housing 11. The transmission mechanism includes a reduction mechanism and an overrunning clutch. The pinion 3 is capable of contacting with and separating from a ring gear (not shown) of the engine. A starter body includes the motor 1, the transmission mechanism and the pinion 3.

A projecting portion (switch box portion) 11*a* is provided at the outer periphery of the housing 11. An electromagnetic switch (main switch) 4 which turns an electric current for the motor 1 on and off is attached to the projecting portion 11*a* through screws 5. Further, the overrunning clutch is operated by the electromagnetic switch 4 through a lever (not shown), thereby moving the pinion 3 back and forth into and out of contact with the ring gear.

An auxiliary switch 8 is mounted to the projecting portion 11a through a supporting member 6 and screws 7. Auxiliary switch mounting seats 12 (hereinafter referred as the mounting seats) for mounting the auxiliary switch 8 are constituted by planar portions formed on the projecting portion 11*a* and threaded holes provided at the planar portions, and the seats are provided at three positions of the projecting portion 11*a* respectively, i.e., the top position, the right side position and the left side position of the projecting portion 11*a* in FIG. 7. Further, the left and right mounting seats 12 are shifted towards the left in FIG. 2 in relation to the top position mounting seat 12. The auxiliary switch 8 is electrically connected to the electromagnetic switch 4 through wires 9. Also, auxiliary switch 8 turns an electric current for exciting the electromagnetic switch 4 on and off by being excited by a key switch (not shown).

A flange member 13 for mounting the housing 11 to the engine is attached to the housing 11. A plurality of engine mounting holes 13*a* for mounting to the engine and a plurality of housing mounting holes 13*b* for mounting to the housing 11 are formed in the flange member 13. Further, a plurality of flange mounting holes 11*b* for mounting to the flange member 13 are formed in the housing 11. So, the mounting angle of the housing 11 to the flange member 13 can be changed by selecting a combination of the flange mounting holes 11*b* and the housing mounting holes 13*b*.

The operation will now be described. The auxiliary switch 8 is excited by turning on the key switch, to thereby exciting the electromagnetic switch 4. Accordingly, an electric current flows into the motor 1 and the pinion 3 is brought into contact with the ring gear, to thereby the rotate ring gear by the transmitted drive force of the motor 1. In large-sized engine starters, since an electric current of hundreds of amperes flows into the motor 1, the electromagnetic switch 4 is not excited directly by the key switch but through the auxiliary switch 8.

In this engine starter, since the mounting seats 12 for mounting the auxiliary switch 8 are provided at three positions, the mounting position of the auxiliary switch 8 can be changed with the same housing 11 by selecting one of the mounting seats 12. Accordingly, the auxiliary switch 8 can be mounted to the same housing 11 without interfering with neighboring equipment or the like with different engine or car body combinations. This allows the standardization of the housing 11. There is therefore no need to produce a new mold and modify present molds, so the costs for producing molds can be reduced.

Further, since the mounting angle of the whole of the engine starter against the engine can be changed by selecting the mounting angle of the housing 11 to the flange member 13, the degree of freedom of the mounting state is further improved by changing the combination of the mounting angle of the housing 1 and the mounting position of the auxiliary switch 8. Furthermore, in this embodiment, since the mounting seats 12 are provided at the projecting portion 11*a* for mounting the electromagnetic switch 4, the auxiliary switch 8 can be disposed nearby the electromagnetic switch 4, to thereby shorten the length of the wires 9 needed and improve reliability.

It should be noted that, while, in the above embodiment, the mounting seats 12 are provided at three positions of the projecting portion 11*a*, the mounting seats may be provided at two or more portions of the housing 11 outside of the projecting portion 11*a*.

What is claimed is:

1. An engine starter, comprising:

a starter body including:

a housing provided with a plurality of auxiliary switch mounting seats, a motor supported by said housing, a pinion capable of being contacted with and separated from a ring gear of an engine, said pinion being rotated by the drive force of said motor, and a transmission mechanism for transmitting the drive force of said motor to said pinion, said transmission mechanism being accommodated in said housing;

an electromagnetic switch for bringing said pinion into contact with said ring gear, for separating said pinion from said ring gear, and for turning an electric current to said motor on and off, said electromagnetic switch being mounted to said housing; and an auxiliary switch for turning an electric current for exciting said electromagnetic switch on and off, said auxiliary switch being mounted to one of said auxiliary switch mounting seats.

2. An engine starter according to claim 1, further comprising a flange member having a plurality of engine mounting holes for mounting to the engine and a plurality of housing mounting holes for mounting to said housing, wherein the mounting angle of said housing to said flange member can be changed.

3. An engine starter according to claim 1, wherein a projecting portion for mounting said electromagnetic switch is provided at the outer periphery of said housing, and said auxiliary switch mounting seats are provided at different positions of said projecting portion.

* * * * *